United States Patent [19]

Kirk et al.

[11] 3,963,617

[45] June 15, 1976

[54] RETRIEVAL MEANS FOR A FLOATING LIQUID SPILLING

[76] Inventors: William P. Kirk, 22 Glenhaven Circle, Saco, Maine 04072; Dwight W. Reynolds, R.F.D. 1, Box 49, Pownal, Maine 04069

[22] Filed: Jan. 22, 1975

[21] Appl. No.: 543,169

[52] U.S. Cl. ..... 210/242 S; 61/1 R; 210/DIG. 25

[51] Int. Cl.[2] ..... E02B 15/04

[58] Field of Search ..... 210/83, 242, DIG. 21; 61/1 R

[56] References Cited

UNITED STATES PATENTS

| | | | |
|---|---|---|---|
| 3,289,415 | 12/1966 | Merrill | 61/1 R |
| 3,653,510 | 4/1972 | Fitzgerald | 210/DIG. 21 |
| 3,667,609 | 6/1972 | Daniel | 210/242 |
| 3,788,079 | 1/1974 | Kirk et al. | 210/DIG. 21 |
| 3,796,656 | 3/1974 | Avey | 210/242 |

*Primary Examiner*—Theodore A. Granger
*Attorney, Agent, or Firm*—Kenway & Jenney

[57] ABSTRACT

A flexible sheet having weight means adapted for spreading the sheet over a liquid spilling and causing it to collapse into a floating position, thereby confining and concentrating a quantity of the spilling. The sheet has central flotation means and a vent for release of entrapped air.

12 Claims, 6 Drawing Figures

FIG. 4
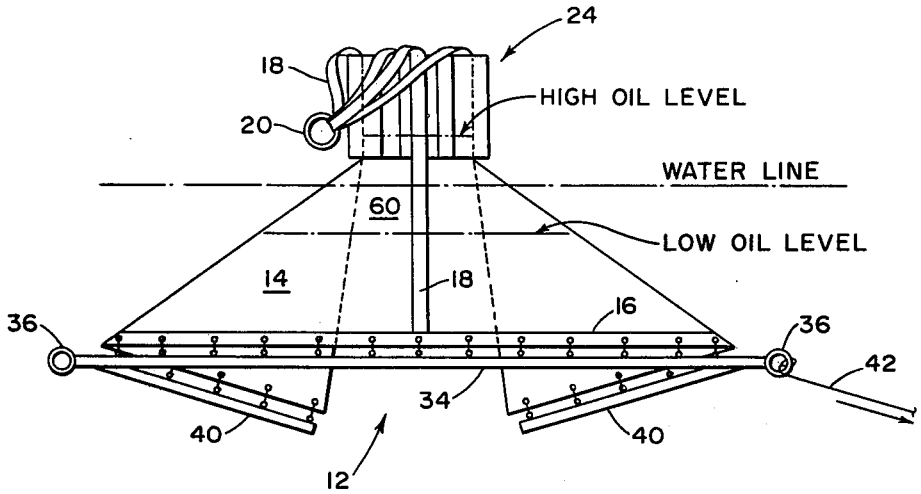
FIG. 5
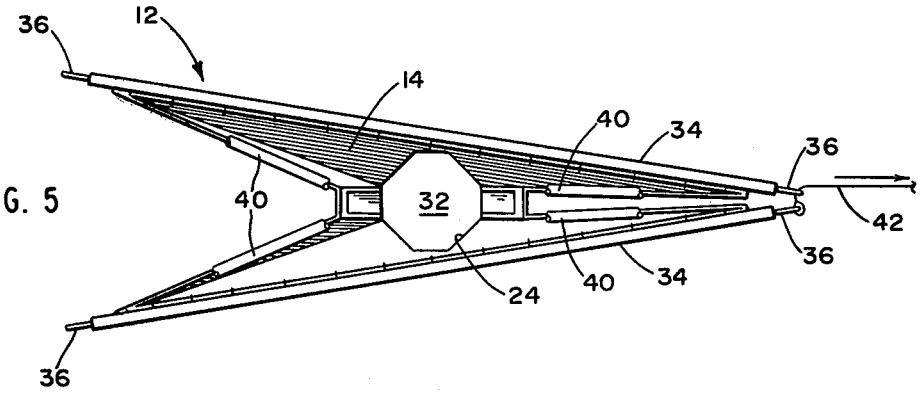
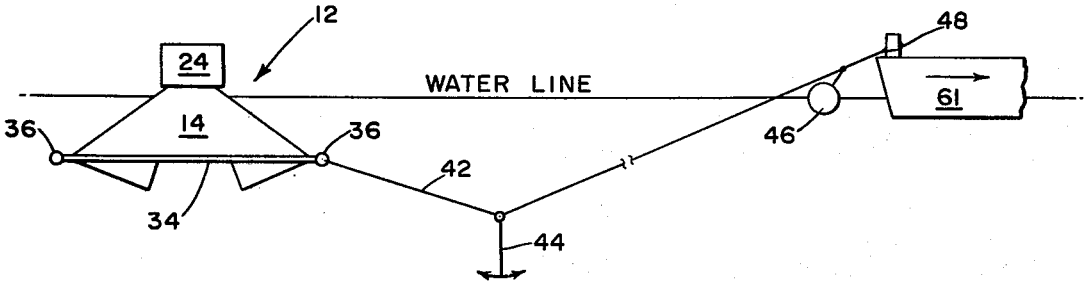
FIG. 6

RETRIEVAL MEANS FOR A FLOATING LIQUID SPILLING

RELATED APPLICATION

U.S. application Ser. No. 543,170, filed on even date herewith by the present applicants, is entitled "Apparatus for Spilling Retrieval." Said application discloses a catamaran having means suitable for deploying retrieval means of the type described in the present application.

BRIEF SUMMARY OF THE INVENTION

This invention relates generally to the art of recovering floating liquids, and particularly oil slicks or spillings from tankers and barges in open water. U.S. Pat. No. 3,788,079, issued Jan. 29, 1974 to the present applicants describes apparatus for recovering floating liquids, comprising a sheet with weighted periphery. The patent describes means for deploying the sheet by use of explosives which spread the sheet horizontally over the liquid surface, after which the periphery submerge, confining and centrally concentrating the floating liquid. A principal object of the present invention is to provide improved retrieval means of a simplified and economical structure, while retaining the desirable features of the collapsible sheet recovery system described in said patent.

Accordingly, it is an object of the present invention to overcome certain disadvantages associated with the oil recovery means now in general use. A principal form of oil containment device now in use is the oil boom, of which many types exist. Oil booms generally work well for booming ships during oil transfer operations, provided that the water currents do not exceed one knot per hour, that the seas are calm and that the winds are gentle. They have not proven satisfactory, however, when used to contain oil spillings or slicks that have spread on open waters. Booms are heavy and cumbersome to handle and to transport, and are difficult to deploy. The deployment operation is time consuming, where speed of deployment is of utmost importance for maximum efficiency of recovery.

Another object of the invention is to provide means for concentrating the liquid spilling, thereby increasing the efficiency of the recovery apparatus. Hitherto, attempts to concentrate contained oil within a boom have proven unproductive. In consequence, some type of skimming operation must be performed within a boom, with attendant costs in manpower and equipment.

With the foregoing and other related objects in view, as will become evident from the following specification, this invention resides in the provision of a structure comprising a flexible sheet having its edges defining a quadrilateral. A pair of opposite edges of the sheet are provided with first and second weight means each extending the length of the edge. The other opposite edges of the sheet are also each provided with weight means, preferably a pair of pipes or bars extending end to end the length of each of said edges.

When the foregoing weighted flexible sheet structure is lowered into the spilling while in a horizontally spread configuration, the weight means swing downwardly to a collapsed position confining and centrally concentrating a quantity of the spilling.

In addition to the weight means, the flexible sheet is provided with flotation means and vent means, the former providing buoyancy additional to that of the confined liquid spilling and the latter facilitating the venting of air entrapped between the sheet and the liquid spilling during deployment of the retrieval means.

The flotation means may comprise a collar-like configuration serving not only to suspend a central portion of the collapsed sheet above the ambient liquid surface, but also to facilitate the venting of entrapped air by supporting pleats in the sheet extending from the collar toward the periphery of the sheet.

The sheet is also provided with a plurality of straps providing means for suspension of the sheet over an area of the liquid spilling for purposes of deployment.

A further feature of the structure resides in the provision of a line secured to a weight means at an edge of the sheet and passing through a loop in a weight means on an opposite edge, with an anchor which, when allowed to fall by gravity, tends to pull said edges of the sheet together, thereby assisting in collapsing the structure. This line may also be provided with an additional length extending from the anchor to form a tow line, with a buoy on the end of the tow line to facilitate its recovery.

BRIEF DESCRIPTION OF THE DRAWING

FIG. 4 is a side elevation of the retrieval means in the collapsed, floating position under tow, and confining a quantity of the spilling.

FIG. 5 is a bottom view of the collapsed, floating retrieval means under tow.

FIG. 6 is an illustration showing the function of the anchor while the retrieval means is under tow.

DETAILED DESCRIPTION

Figure 1:
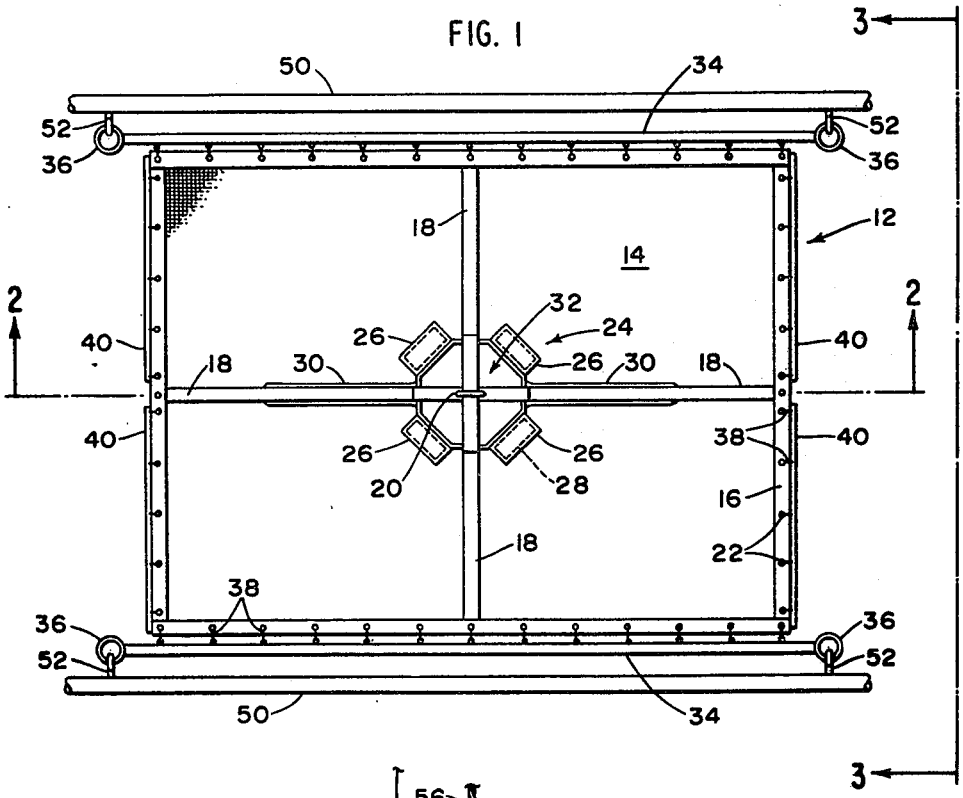
FIG. 1 is a plan view of a preferred embodiment of the retrieval means.
Figure 2:
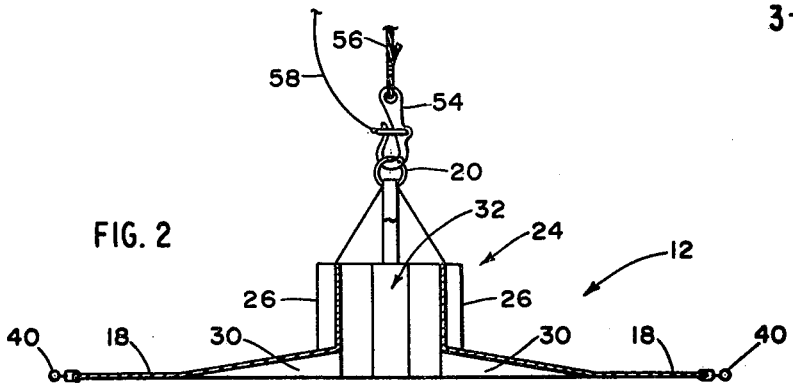
FIG. 2 is an elevation in section taken on line 2—2 of FIG. 1, showing the retrieval means held and suspended in spread configuration preparatory to release.
Figure 3:
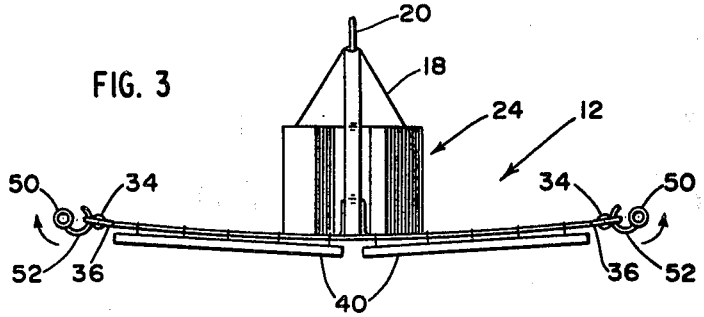
FIG. 3 is an elevation in section taken on line 3—3 of FIG. 1.

Referring to the drawings which show a preferred embodiment of the invention, the retrieval means is designated at 12 and comprises a flexible sheet 14 with weighted edges and accessory parts for purposes of flotation, deployment and retrieval. The sheet is impervious to the liquid spilling, for example an oil slick floating on the water of a harbor or the ocean. A wide variety of suitable sheet materials may be used. In the experimental forms produced by the applicants the material selected was woven nylon sail cloth coated with a waterproofing plastic material. The sheet may be constructed of one or more pieces stitched together to form a quadrilateral, illustrated in the drawing as a rectangle. The edges of the sheet are preferably hemmed and reinforced with woven cloth webbing tapes 16. Additional woven cloth webbing tapes 18 are stitched to the sheet and extend from the edges of the sheet toward the center, each of these tapes having loose ends attached to a central lifting ring 20. Grommets 22 are fastened to the tapes 16 at spaced intervals around the entire periphery of the sheet 14.

The sheet 14 is preferably provided with central flotation means comprising a collar 24. The collar comprises four cloth bags or pockets 26 joined together in mutually spaced relation by fabric in an annular arrangement. Each of the pockets contains a block 28 of flotation material, such as a closed cellular foam plastic material, or any other material commonly used for flotation in boats, life jackets and the like.

The pockets 26 are joined to one another and to the sheet 14 in such manner as to produce pleats 30 in the sheet 14, the joining fabric forming a central opening 32 in the sheet 14, and the pleats extending along and beneath the webbing tapes 18 and terminating at spaces between the mutually spaced lower portions of pairs of the pockets 26. Thus the pleats 30 provide air channels from spaced points under the sheet, the channels communicating with the central opening 32 through which air under the sheet may pass freely to the atmosphere above the sheet.

The retrieval means is further provided with first and second weight means comprising a pair of side rods 34 preferably of identical form and preferably comprising either substantially rigid metal rods of solid cross section or metal pipes, each extending substantially the length of one of two opposite side edges of the sheet. Alternatively, non-rigid weight means such as chains may be substituted for the side rods 34. A ring 36 is secured to each end of each of the side rods, and serves for supporting and deploying the retrieval means as hereinafter described. Each of the side rods is secured to the sheet 14 by means of a number of T-chains 38, or by snaps, rings, loops or other suitable fasteners passing through the grommets 22.

Each of the other side edges of the sheet 14 has attached to it a pair of end rods 40, the end rods being attached to the sheet by means of additional T-chains 38, or like means as described above. The end rods extend end-to-end substantially the length of each of the side edges and are mutually pivotal in the regions adjacent ends of the webbing tapes 18, by reason of the flexibility of these tapes and of the material of the sheet 14. In the preferred embodiment the end rods 40 are rigid with their respective ends located adjacent ends of the tapes 18. Alternatively, non-rigid weight means such as chains may be substituted for the end rods 40. Thus the weight means around the entire periphery of the sheet 14 may consist of one or more chains instead of the rods illustrated in the drawing.

A tow line 42 is attached to one of the rings 36 on the side rods 34 (FIG. 5) and passes through a ring 36 on the opposite side rod. The line 42 extends to an anchor 44 (FIG. 6), and extends beyond the anchor to form a buoy line fastened to a buoy 46, with a further portion defining a retrieval loop 48. By this means, as further described below, tension on the line 42 draws the rings 36 toward one another, thereby tending to hold the retrieval means in a collapsed configuration.

To deploy the above-described retrieval means, a pair of mutually spaced parallel spreader rods 50, which may take the form of pipes as illustrated, are provided with hooks 52, the hooks being open to receive the rings 36. Each of the spreader rods 50 is rotatable about its longitudinal axis. The axes of the spreader rods are held in fixed spaced relationship. In addition, the retrieval means is held suspended by means of a pelican hook 54 passing through the lifting ring 20, the hook being attached to the end of a hoist line 56 and having a quick release line 58.

To release the retrieval means, the spreader rods 50 are rotated in opposite directions, and substantially simultaneously the quick release line 58 is pulled to allow the pelican hook to release the lifting ring 20. The retrieval means then falls into the floating liquid by its own weight, the edges of the sheet 14 are quickly submerged by the weight of the side rods 34 and end rods 40. As the side rods 34 submerge they are drawn toward one another, thereby causing each of the pairs of end rods 40 to pivot into a collapsed position as shown in FIG. 4. Trapped air under the sheet is vented through the opening 32. In this manner the sheet 14 confines and concentrates a quantity 60 of the oil or other floating liquid to be retrieved.

As shown in FIG. 4, the weight of the entire retrieval means including the anchor 44 is suspended by the buoyancy of the contained oil 60; however, if insufficient oil is retrieved to provide this buoyancy, the flotation collar will become partially submerged and will thereby provide any additional buoyancy required.

Thus the retrieved body 60 of liquid is confined within the retrieval means in such manner that it will not be released under windy or rough water conditions. The retrieval means may be allowed to float freely, in which case the line 42 hangs vertically down to the suspended anchor 44 and the buoy 46 floats at the water surface to provide a readily observable means for locating the retrieval loop 48. Thus the anchor and line provide means in addition to the weight of the end rods and side rods to hold the retrieval means in its collapsed configuration.

If the retrieval means floats into shoal waters under the action of wind and waves, the anchor 44 eventually fetches up on the bottom and holds the retrieval means in configuration of FIGS. 4 and 5, wherein the direction toward which it tends to be moved is leftwardly as illustrated. Thus means are provided to prevent the retrieval means from being capsized in the shoal waters.

The retrieval means may be approached in its floating position and recaptured by the catamaran of said copending application, or it may be approached by a vessel equipped with a pump and storage tank, and a suction hose may be inserted into the central opening 32 for pumping out the contained oil. Alternatively, the retrieval means may be towed as illustrated in FIG. 6. In this case the retrieval loop 48 is made fast to a vessel 61. With the vessel moving in the direction indicated by the arrow, the tow line 42 is held under tension with the anchor 44 holding the portion attached to the retrieval means in a downwardly directed orientation, thus preventing the retrieval means from pitching and possibly losing a quantity of the contained oil 60.

We claim:

1. Retrieval means for a floating liquid spilling comprising the combination of a flexible sheet having edges forming a polygonal periphery and flotation means attached to a portion of the sheet inwardly of said periphery, first and second weight means each extending along an edge of the sheet with the flotation means therebetween, each said weight means being elongate, relatively inflexible and attached along its length to one said edge, and third and fourth weight means each comprising a first elongate portion having one end hinged to the first weight means and a second elongate portion having one end hinged to the second weight means, the other ends of the first and second portions being mutually hinged, each of said first and second portions being attached along its length to the sheet, said third and fourth weight means extending between the first and second weight means with the flotation means therebetween and being adapted, upon the sheet falling freely on to the spilling while spread out generally parallel to the spilling surface, to permit the first and second portions to fold together in response to the sinking of the first and second weight means and movement thereof together, thereby confining and concentrating a quantity of the spilling at the region of the flotation means.

2. Retrieval means according to claim 1, in which the sheet is rectangular.

3. Retrieval means according to claim 1, in which each of the third and fourth weight means comprises a pair of mutually pivotal stiff elongate weights extending end to end between the first and second weight means.

4. Retrieval means according to claim 3, in which the sheet is substantially rectangular.

5. Retrieval means according to claim 1, having a vent to atmosphere for air trapped between the sheet and the spilling.

6. Retrieval means according to claim 1, in which the flotation means comprise a buoyant member in position to suspend said portion of the sheet above the surface of the ambient spilling.

7. Retrieval means according to claim 6, having a vent with an air passage through said portion of the sheet.

8. Retrieval means according to claim 7, in which the flotation means are attached to the sheet to form at least one elongate pleat therein, the pleat being elevated in relation to adjacent portions of the sheet and extending toward an edge of the sheet to provide a passage for conducting air to said vent.

9. Retrieval means according to claim 8, in which the flotation means comprise a plurality of bodies forming a collar of buoyant material, two of said bodies being spaced to define the pleat.

10. Retrieval means according to claim 1, in which one of said first and second weight means has a loop on at least one end thereof, and including a line attached to the other of said first and second weight means and passing through said loop, and an anchor attached to the line.

11. Retrieval means according to claim 10, in which the line is attached to an end of the other of said first and second weight means.

12. Retrieval means according to claim 10, having a buoy attached to the line, the anchor being attached to the line between the buoy and the other of said first and second weight means.

* * * * *